US011002058B1

(12) United States Patent
Boor

(10) Patent No.: US 11,002,058 B1
(45) **Date of Patent: *May 11, 2021**

(54) MECHANICAL MONO-FOLD DOOR

(71) Applicant: Lester Building Systems, LLC, Lester Prairie, MN (US)

(72) Inventor: Paul A. Boor, Hutchinson, MN (US)

(73) Assignee: Lester Building Systems, LLC, Lester Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/801,052

(22) Filed: Feb. 25, 2020

Related U.S. Application Data

(63) Continuation-in-part of application No. 15/674,422, filed on Aug. 10, 2017, now Pat. No. 10,597,925.

(60) Provisional application No. 62/373,014, filed on Aug. 10, 2016.

(51) Int. Cl.
*E05F 11/00* (2006.01)
*E05F 15/627* (2015.01)
*E05F 15/616* (2015.01)

(52) U.S. Cl.
CPC ..... *E05F 15/627* (2015.01); *E05F 15/616* (2015.01); *E05Y 2900/132* (2013.01)

(58) Field of Classification Search
CPC ..... E05F 15/627; E05F 15/616; E05Y 2900/106; E05Y 2900/132
USPC ..... 49/197, 199, 200, 203, 204, 325, 339, 49/340, 341, 344, 347, 356
See application file for complete search history.

(56) References Cited

U.S. PATENT DOCUMENTS

| | | | | |
|---|---|---|---|---|
| 1,273,923 A | | 7/1918 | Prescott | |
| 1,275,591 A | | 8/1918 | Ogden | |
| 1,386,192 A | | 8/1921 | McCloud | |
| 1,579,677 A | | 4/1926 | Tomkinson | |
| 4,019,442 A | * | 4/1977 | Lee | B60P 7/14 410/130 |
| 4,248,016 A | * | 2/1981 | Pecchioni | E05F 15/684 49/199 |
| 4,637,446 A | * | 1/1987 | McQueen | E05D 15/262 160/207 |
| 5,020,580 A | * | 6/1991 | Dalman | E05D 15/262 160/188 |
| 5,572,829 A | * | 11/1996 | Stoltenberg | E05D 15/165 49/200 |

(Continued)

FOREIGN PATENT DOCUMENTS

FR 300516 A1 7/2014

*Primary Examiner* — Jerry E Redman
(74) *Attorney, Agent, or Firm* — Glen E. Schumann; Moss & Barnett

(57) ABSTRACT

The monolithic door of the present invention includes a single panel door having a top edge and a front and back side. The door is hinged at the top edge, within a door opening, to a structure (in one embodiment, a door frame header). A winding mechanism is secured towards the top of a first vertical member of the door frame and a second winding mechanism is secured towards the top of a second vertical member of the door frame, opposite the first vertical member. A compression strut on each side of the door is secured to tension straps or cables which are in turn attached to a corresponding winding mechanism secured to the structure. An actuator operatively connected to the winding mechanisms rotates the drums to either force the door open or allow the door to close.

20 Claims, 12 Drawing Sheets

(56) References Cited

U.S. PATENT DOCUMENTS

| | | | | |
|---|---|---|---|---|
| 5,588,258 | A * | 12/1996 | Wright | E05F 15/627 49/340 |
| 9,593,525 | B1 * | 3/2017 | Morris | E04F 10/10 |
| 10,253,543 | B2 | 4/2019 | Newman | |
| 10,597,925 | B1 * | 3/2020 | Boor | E05F 15/616 |
| 2002/0029524 | A1 | 3/2002 | Kerkvliet | |
| 2012/0222825 | A1 | 9/2012 | Taddei | |
| 2012/0313495 | A1 | 12/2012 | Fan | |
| 2013/0319623 | A1 | 12/2013 | Crown | |
| 2014/0373451 | A1 | 12/2014 | Betker | |
| 2015/0368950 | A1 | 12/2015 | Baczweski | |
| 2016/0333629 | A1 | 11/2016 | Betker | |
| 2016/0376830 | A1 | 12/2016 | Crown | |
| 2017/0016259 | A1 | 1/2017 | Schweiss | |
| 2017/0074019 | A1 | 3/2017 | Schweiss | |
| 2018/0283084 | A1 | 10/2018 | Schweiss | |

* cited by examiner

| Door Type | Space req. (in) | | Time | Cost for Width | | | Width (ft) | | Energy | Auto- |
|---|---|---|---|---|---|---|---|---|---|---|
| | Head | Side | (sec.) | <16' | 16' - 26' | >26' | Practical | Max | Efficiency | mation |
| **Over Head** | 12 - 32 | 6 | 30 | low | Medium | High | 24 | 32 | Medium | Yes |
| **Slider** | 0 | =Width | 120 | low | Low | Low | 40 | 48 | Low | Minimal |
| **Bi-Fold** | 24 - 36 | 6 | 60 | Medium | Medium | Medium | 60 | 80+ | Med-Hi | Yes |
| **Mono-Fold Hydraulic** | 0 | 6 | 120 | High | High | High | 60 | 80+ | High | Yes |
| **Mono-Fold Mechanical** | 0 | 6 | 60 | Medium | Medium | Medium | 60 | 80+ | High | Yes |

FIG. 4

MECHANICAL MONO-FOLD DOOR

REFERENCE TO RELATED APPLICATIONS

This application is a Continuation-in-Part of Non-Provisional application Ser. No. 15/674,422, filed Aug. 10, 2017, which is now patented as U.S. Pat. No. 10,597,925 on Mar. 24, 2020, which claims the benefit of Provisional Application No. 62/373,014, filed Aug. 10, 2016. The contents of which are incorporated herein by reference.

FIELD OF THE INVENTION

The present invention is related to single panel, top hinged doors (hereafter designated mono-fold doors). The invention can be used for external doorways or windows or other external and internal passageways requiring a door or panel that opens and closes.

BACKGROUND OF THE INVENTION

There are several types of building doors currently in frequent use, including: overhead doors, sliding doors, bi-fold doors, and hydraulic mono-fold doors. Further, many HVAC vents include baffles that open or close to allow or prevent passage of air through the vents.

Overhead doors ("OHDs") typically can be 18 feet to 24 feet tall by various door widths. Door segments are stacked vertically into a track system that is mounted to the structure at the door sides. The track curves into the building above the door opening. Typically, a minimum of 12" of headroom is required above the door opening; very large OHDs require as much as 36" of headroom. OHDs frequently include a torsion spring to counter balance door weight. The spring stores energy as the door is closed and releases it as the door opens, thus minimizing the effort required to open the door and reducing closing force. OHDs are often combined with an electric motor and controls that allow the door to be opened remotely. The horizontal seams inherent in OHD panels and the sliding that occurs at door sides often result in significant air infiltration and significant energy losses. OHDs are very competitive when the doors are less than 16' wide; they become relatively expensive when they are wider than 24' and widths greater than 30' are possible but the cost increases rapidly.

Sliding doors are nearly always the lowest cost door option and require no or very minimal headroom, and can be accessorized in a manner similar to the walls which they resemble. However, sliding doors are notoriously difficult to insulate and weather-strip and require substantial side room making them impractical when continuous openings are required, Double sliding doors up to 40 feet wide×20 feet tall are common. Walk doors, windows and a variety of finish materials can be incorporated into a sliding door. Sliding doors that include cross bucks and windows are often used to improve aesthetics of the building.

Sliding doors are available in a number of styles, the most common include single and double sliders. A third style of sliding door that is not as common is referred to as a "quad door." The sliding door is formed by building a light frame and covering that frame with corrugated steel sheathing. The assembly is very similar to the building wall; the wall segments or "door leaves" are then suspended from rollers running in a horizontal track located above the door. Sliders can occur on the inside or outside of the building wall.

Bi-Fold Doors consist of two full width door segments. In one embodiment, welded tube steel frames sheathed with the same material as the building wall are typically used to form door panel segments. The upper segment is hinged to the building at the top and the lower segment at the bottom. The lower segment is hinged to the upper segment at the top. Rollers located at and typically extending laterally from the bottom corners of the bottom segment engage vertical tracks mounted to the building at the sides of the door opening. Cables or straps are attached to the bottom and top of the door at intervals across the doors width. A winding mechanism shortens the cables or straps causing the bottom to be lifted toward the top of the door, while the center of the door pushes out as the door is opened.

In the door open position, the bottom bi-fold panel typically hangs 24"-30" below the hinges mounted at the top of the bottom panel, limiting the available doorway height. Bi-fold doors can be insulated like the building's walls but weather stripping is somewhat difficult because of the lift/sliding motion of the door relative to the doorjamb, and the steel frame creates thermal shorts that can significantly impact thermal performance.

Hydraulic Mono-Fold doors use a pair of hydraulic cylinders to open a single monolithic door slab hinged at the top of the slab to a door frame or header. The cylinders are located so that the door is forced to swing away from the building as the cylinders are extended. Only the perimeter of Mono-Fold doors needs to be weather stripped. The door moves directly away from the door jamb which allows effective weather stripping. The door can be insulated and accessories such as electricity and light can be added to the door much like a stationary wall.

The hydraulic system used to power mono-fold doors is noisy, messy, expensive, and unreliable, cold weather negatively impacts door speed, thermal lock can prevent the doors from opening or closing and it is difficult to force the doors to open level relative to the height of the door.

Storage and manufacturing buildings often require large doors to allow efficient movement of materials and equipment into and out of the structure. The ideal door would provide all of the following features: No head room requirement, minimal side room requirements, the doors should be able to open and close effectively, quickly and safely, low cost, easy incorporation of accessories, including, but not limited to windows and walk doors and it would be easy to insulate and effectively weather-strip.

PRIOR ART

During the prosecution of Non-Provisional application Ser. No. 15/674,422 filed Aug. 10, 2017, the examiner cited to U.S. Pat. No. 1,386,192 in favor of E. H. McCloud. The McCloud invention differs from the present invention in that McCloud utilizes a multi-panel door. To open the door requires two operations: first, a lower panel must be lifted up behind an upper panel and locked into position; only then can the combined door panels be rotated to an open position.

The "strut" mechanism utilized by McCloud is pivotally secured to the upper panel of the outer panel at a first end of the strut. A roller is attached at a second end of the strut that rides up a linear (vertical) section of the door frame. The trailing end of the McCloud strut is always braced against a fixed surface. This is unlike the present invention, which has at least one and commonly two free-floating strut ends. In effect, McCloud discloses a one dimensional movement of the trailing end of the strut (up and down vertically). In contrast, the present invention allows for two dimensional movement of the trailing end of the strut (and often the leading end of the strut as well). That movement includes an "x" and "y" component. Further, the McCloud door system is actuated by applying a generally vertical force on the trailing edge of the strut, whereas the present invention applies a force to the strut that is more generally horizontal initially. Thus, McCloud does not teach, motivate or suggest the two dimensional, free-floating system of the present invention with a generally horizontal application of force on the strut as the door is initially opened.

SUMMARY OF THE INVENTION

The present invention is a mechanical mono-fold door that takes the physical attributes resulting from a single monolithic door slab and combines it with the low cost and reliability of a simple mechanical drive system.

The monolithic door of the present invention includes a single panel door having a top edge and a front and back side. The door is hinged at the top edge, within an opening, to a structure (in one embodiment, a door frame header).

A typical opening in which the present invention is mounted includes spaced first and second vertical members and a horizontal header extending between and attached at or above the top of the vertical members to form a door opening, although other openings are anticipated by the present invention.

In one preferred embodiment, a winding mechanism is secured towards the top of the first vertical member of the door frame. A tension strap or a cable is mounted at a first end to the winding mechanism. (Although a tension strap and a cable are different, they perform a similar function as applied to the present invention and are hereinafter interchangeably referred to as a "tension strap.") A second end of the tension strap is connected to a first end of a compression strut. The tension strap may be wound around one or more guide sheaves mounted on the building structure. The guide sheave may be fixed or rotatably mounted. When the tension cable is wound on the winding mechanism, the force of the tension strap acting on the compression strut will cause one end of the strut to move into engagement with a pivotally mounted door to cause the door to move from a closed position to an open position.

In another preferred embodiment, a winding mechanism is secured towards the top of the first vertical member of the door frame. A first tension strap is mounted at a first end to the winding mechanism. A second end of the first tension strap is connected to a first end of a compression strut. The tension strap may be wound around one or more guide sheaves mounted to the building structure, such as a vertical member. (Strategically placed guide sheaves are attached to the building structure to guide movement of the tension straps and the force applied by the tension straps to the strut.) Additionally, a first end of a second tension strap is secured to the winding mechanism and the second tension strap may be wound around guide sheaves mounted on the building structure, which guide sheave(s) may be fixed or rotatably mounted. A second end of the second tension strap is secured to a second end of the compression strut. In operation, when the tension cables are wound on the winding mechanism, the force of the tension straps acting on the first and second ends of the compression strut will cause one end of the strut to move into engagement with a pivotally mounted door to cause the door to move from a closed position to an open position.

A cam style winding mechanism can also be utilized to optimize door operating parameters such as door speed as well as power and torque requirements to produce specific types of motion of the strut.

An actuator is secured to the building structure in operative engagement with the winding mechanism to rotate the drum. In one preferred embodiment, the actuator is an electric motor with a worm gear that engages a corresponding bull gear of the winding mechanism to rotate the winding drum.

Winding the tension straps on their respective winding mechanism causes the first end of the compression strut to be drawn up the back side of the door, causing the door to move upward to an open position. Unwinding the tension straps causes the first end of the compression struts to move down the back side of the door, allowing the door to lower to a closed position.

The strut, strap/cable and winding mechanism replace the hydraulic system currently employed on mono-fold doors.

In one embodiment, the tension straps may be connected offset from the first and second ends of the strut for a desired movement of the strut.

In another embodiment, the door opening systems described above can be mounted on each of the vertical members of a doorway so that lifting of the door occurs on both sides of the door.

In another embodiment, a track can also be added to the back side of the door and a roller or other engagement means can be added to one end of the strut to inextricably engage the track. In this configuration, one end of the compression strut will always be in contact with the back side of the door.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 4 is a table illustrating typical characteristics of various types of doors;

DETAILED DESCRIPTION OF THE INVENTION

The monolithic door of the present invention is designed for use in a typical building doorway or window frame. Two framing systems are typically used with the door of the present invention (although other framing arrangements are possible). A first framing system has girts that span the full width of the door attaching to a single vertical at each end. A second framing system includes interior vertical framing members that are attached to a truss or beam that spans the full width of the door. The embodiments described herein are described using the first framing system.

Additionally, the invention can be used for other types of openings requiring a door. By way of example and without limitation, the system can be utilized in HVAC vents that require a damper, which are valves or plates that stop or regulate the flow of air inside a duct, chimney, VAV box, air handler, or can be utilized in other structures that require the opening or closing of a door.

For simplicity, the invention will be described in terms of an external building door mechanism. However, references to a "building" herein should not be viewed as limiting, but should be interpreted as any structure that has an opening to accommodate a door.

Figure 1:
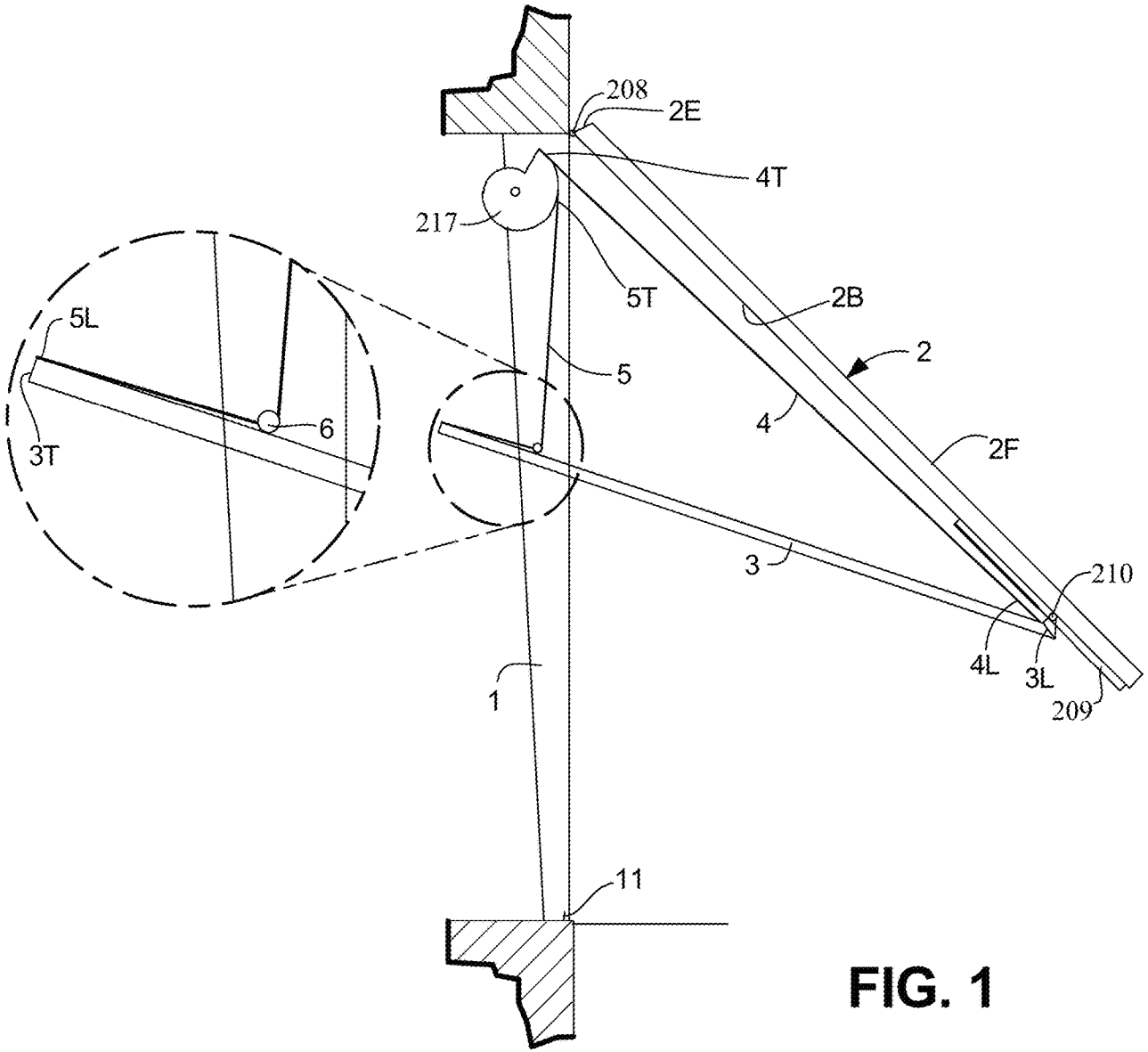
FIG. 1 is a side view of a first preferred embodiment of the present invention, illustrating the orientation of the winding mechanism, compression strut, tension straps and door, when the door is in a partially open position.

Referring to the embodiment of FIG. 1, door jamb column 1 provides the static structure that supports the active components of the door opening system. The jamb column is integral to the building structure, the door opener and the door. The jamb column can be made from wood, steel or other suitable material. The jamb column can be a single element with the opening mechanism mounted on one side, or a pair of elements spaced some distance apart with an operating mechanism located between the spaced elements. In another preferred embodiment, two operating mechanisms can be utilized, one mechanism mounted on each of two spaced jamb columns located on opposite sides of the door. (A single mechanism located on one side of the door may more commonly be used for narrow doors.)

Door 2 is a single slab or panel that may be field assembled from individual framing members much like a building wall or be factory assembled and be delivered as a welded frame. Sheathing and insulation is typically installed on the door in the field. The door slab includes a top edge 2E, a front side 2F and a back side 2B. The door is hinged at the top edge 2E to a girt or header as shown in FIG. 1. Door 2 pivots out from the building. A latch plate 11, shown as located at the bottom of the jamb column in FIG. 1 (but other locations are possible), secures the door in its closed position.

In one preferred embodiment shown in FIG. 1, a first winding mechanism 18 having a cam-shape is secured towards the top of a first jamb column 1 and a second winding mechanism (not shown) having the same cam shape is secured towards the top of a second jamb column (not shown), spaced from the first jamb column 1. (However, for other embodiments, it is anticipated that any number of winding mechanisms might be strategically placed to wind and unwind the tension strap(s) to open and close a door.)

Figure 3:
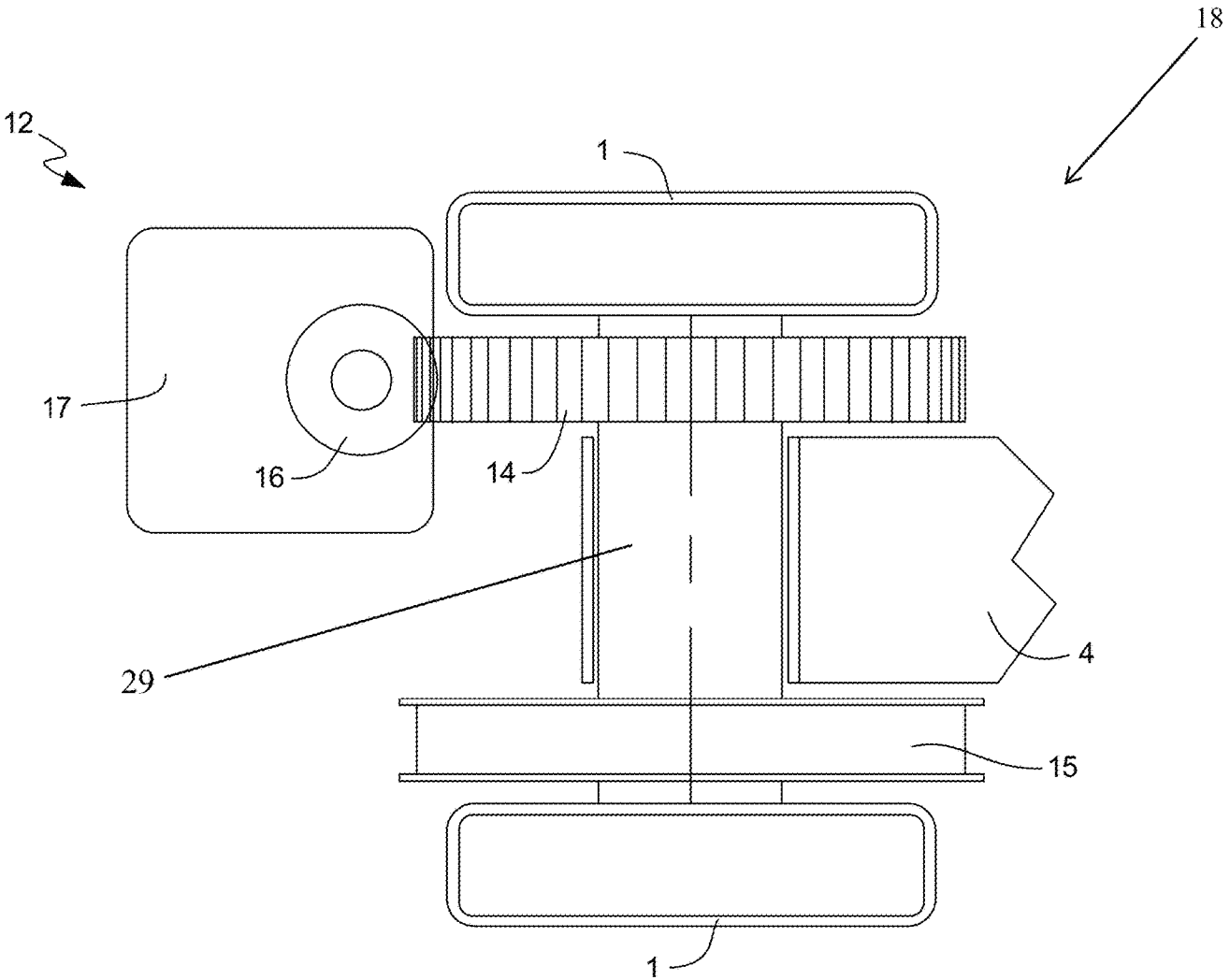
FIG. 3 is a top view of the winding mechanism and actuator.

Referring to FIG. 3, each winding mechanism includes a shaft, spool, bar or drum 29 to which tension straps are attached by known means, that is rotated, typically by a motor 17 via speed reducing gearing, chains, or belts (although other power sources including manual inputs can be used), such that the tension straps wrap around the winding mechanism thereby shortening the strap. This in turn activates a corresponding compression strut 3 (FIG. 1), causing the strut to move and act upon the door 2 to open the door. When corresponding sets of tension straps 4 and 5 are unwound from the shaft spool or drum, it allows the door to close.

The winding mechanisms can be sized such that less than one revolution is required to fully open the door. In this case the drum is not circular—it has a cam shape. The local radii can vary such that the winding surface forms a logarithmic curve similar to a snail shell. Reducing the wrap radii as the door opens can offset the increasing moment arm of the door such that, for a constant rotational velocity of the drum, input power is constant.

Further, the tension straps 4 and 5 attached to each winding mechanism and corresponding strut can be attached to the cam-shaped drum at different locations and angles to control the speed and distance the tension straps will travel when the cam-shaped drum is rotated. The cam surface and point of connection to the cam greatly impact which strap is actuated first and force applied by the strap on the strut. In one embodiment, the cam is designed for one rotation to fully open the door.

As shown in FIG. 1, for each winding mechanism assembly attached to the door, a leading end 4L of a first or "leading" tension strap 4 is connected to a first "lower" or "lead" end 3L of the compression strut 3. A trailing end 4T of tension strap 4 is connected to the cam-shaped drum 217 by known means. A trailing end 5T of a trailing strap 5 is also attached to the drum 217 by known means. Trailing strap 5 winds around one or more strategically placed guide sheave(s) 6 mounted on the building structure (in one embodiment, a vertical jamb column) and a leading end 5L of strap 5 is secured to a second "upper" or trailing end 3T of the compression strut 3. Tension strap 5 starts at the winding mechanism, extends down to and below sheave 6 (to the right and around the bottom of the guide sheaves 6 as shown in FIG. 1), towards trailing end 3T, parallel to the top side of compression strut 3, and finally attaches to the end 3T of compression strut 3 by known means. In this arrangement, the first lower or lead end 3L of the compression strut 3 is in contact with the back side 2B of the door 2.

The straps shorten as the winding mechanism turns and winds the straps on the drum, pulling the leading end of the compression strut up the back side of the door. This causes the door to move to its open position. Reversing the direction of the winding mechanism causes the straps to unwind, allowing the door to move to its closed position.

The strategically placed guide sheaves 6 redirects the tension straps such that the tension force vectors will force the compression strut 3 down and out (in the direction of the back side of the door 2B) to open the door 2. In operation, the trailing end 5T tension strap 5 is redirected by the guide sheave 6 such that pulling up on the trailing end 5T of the tension strap draws the trailing end 3T of the compression strut 3 towards the guide sheave 6, pushing the leading edge 3L of the compression strut 3 into and upward against the back side 2B of the door 2, causing the door to open. The number and location of the guide sheaves can be strategically modified to further optimize the cable force and speed.

The trailing end of the strut can move toward the door until no more tension strap is left to the back of the pulley at 3T. The leading end of the strut can roll up back of the door until it reaches the end of the track.

As shown in FIG. 3, an actuator 12 including a Numerically Controlled Servo Motor with Speed Reducer (drive) 17 is secured to the building structure in operative engagement with the winding mechanism 18. In one preferred embodiment, the actuator 12 is an electric motor with a worm gear 16 that engages a corresponding bull gear 14 of the winding mechanism to rotate the winding drum 29. A counter balance guide sheave is added as shown at 15.

Both the leading and trailing tension straps can be connected to a common winding mechanism or multiple winding mechanisms can be utilized, one for each strap. Separate winding mechanisms allow independent operation of the tension straps. Independent strap operation allows more complex movement of the compression strut 3 enabling ancillary benefits such as door latching. When a pair of these door opening mechanisms are utilized to open a door, using servo motors allows full coordination between all four straps associated with opening the door. As with a single winding mechanism, when using separate winding mechanisms for each strap, winding the tension straps on their respective winding mechanisms causes the leading end 3L of the compression struts to be drawn up the back side of the door 2B while the trailing end 3T is being pulled toward the guide sheave, by forcing the compression strut into the back side of the door and the door to open. The combined effect of the two straps is to force the compression strut 3 to press against the door 2 as the tension straps rotate about or slide by the guide sheaves 6 in FIG. 1. The leading end 3L of the compression strut 3 follows a curved, upward path outside the building as it forces the door open. Unwinding the tension straps causes the leading end 3L of the compression struts 3 to move down the door 2 while the strut moves into the building, allowing the door to lower to a closed position.

When using more than one mechanism to open a door, such as the door opener of the present invention mounted on opposing door jamb columns, synchronization can be ensured via a connecting rod that forces the two winding mechanisms to turn in unison. Conversely, independent servo motors can be located at each side of the door and programmed to wind independent hubs simultaneously.

Figure 1A:
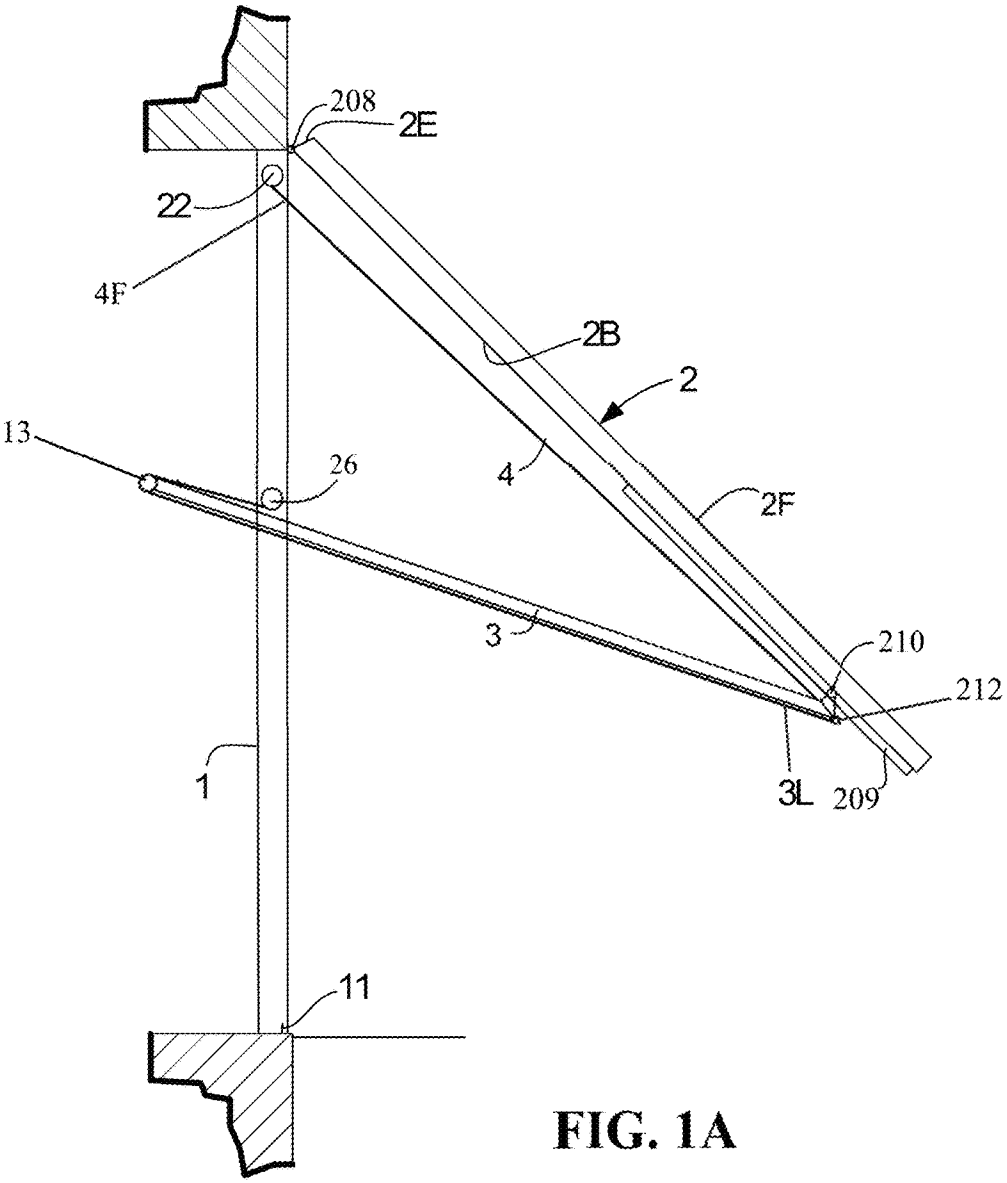
FIG. 1A is an alternate embodiment of FIG. 1, utilizing a single continuous tension strap.

In an alternate embodiment of FIG. 1, as shown in FIG. 1A, one continuous tension strap can be utilized with one winding mechanism 22. A first end 4F of the strap is connected to the winding mechanism. The tension strap extends to and around a roller 212 located at the leading end 3L of the strut 3 and winds back, generally parallel to the bottom of strut 3, to and around a roller 13 located at the trailing end 3T of strut 3, to the top of strut 3 to a fixed sheave 26. A roller 210 also secured to leading end 3L of strut 3 engages a track or guide 209 located on the back side 2B of the door slab 2. In one embodiment, the track may include an outer wear surface and the roller 210 rolls up and down the wear surface. In another embodiment, the roller 210 will be inextricably mounted on or in track or guide 209 to roll up and down the track. With this arrangement, only one end of the strut will move at any time. The end that moves with the smaller cable force will go first.

FIG. 1A shows a circular winding mechanism although a cam could be used, as shown in FIG. 1. The cam arrangement of the winding mechanism allows the movement of the tension strap(s) to optimize door operating parameters and enabling secondary operations such as latching the door.

Counter weights (not shown) can be incorporated by winding another tension strap or cable around the winding mechanism in the opposite direction of the door strap(s) such that as the door opens the counter weight descends. The addition of counter weights reduces input power requirements and the size of drive components.

Figure 2:
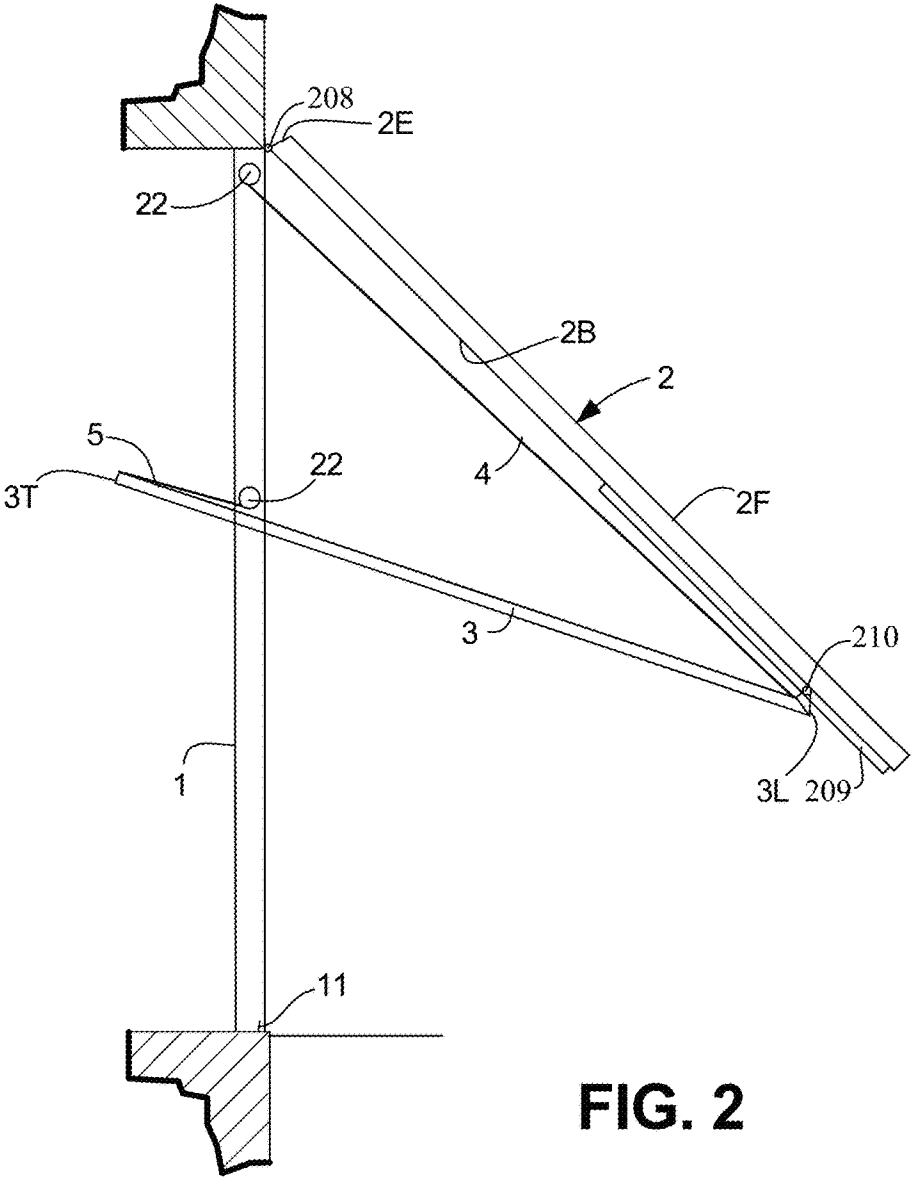
FIG. 2 is a side view of a second preferred embodiment of the present invention, illustrating the orientation of the winding mechanism, compression strut, tension straps and door, when the door is in a partially open position.

Another preferred embodiment is shown in FIG. 2. Two straps (4, 5) and two winches 22 are utilized. A roller 210 secured to a leading end 3L of strut 3 engages a track or guide 209 located on the back side 2B of the door slab 2. In one embodiment, the track may include an outer wear surface and the roller 210 rolls up and down the wear surface. In another embodiment, the roller 210 will be inextricably mounted on or in track or guide 209 to roll up and down the track. No sheaves are utilized in this embodiment.

Figure 5C:
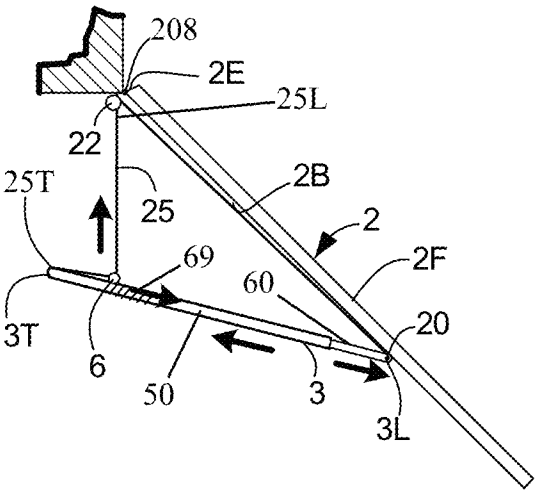
FIG. 5C is yet another alternate embodiment of the present invention.

Other embodiments of the invention are possible. One such embodiment, referred to as the "single active end" embodiment, is illustrated in FIG. 5A. The leading end 3L of the compression strut 3 is hinged to the door at 20. Hence the leading end of the compression strut 3L does not move with respect to the door. All of the door's motion is achieved by moving the trailing end 3T of the compression strut 3 with the tension strap 25 upon actuation of winding mechanism 22. A guide sheave is shown at 6, which operates in a similar fashion as was described above.

Figure 5B:
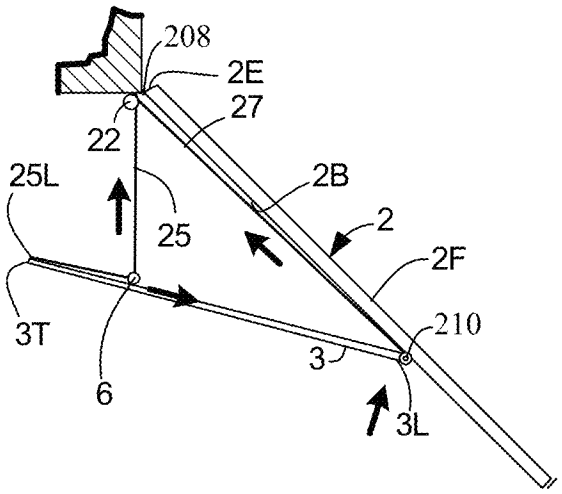
FIG. 5B is yet another alternate embodiment of the present invention.
Figure 5A:
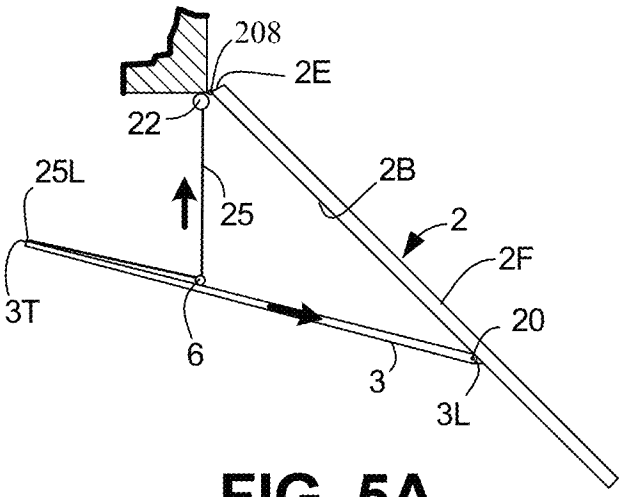
FIG. 5A is an alternate embodiment of the present invention.

Another preferred embodiment, referred to as the "double active end" embodiment, is illustrated in FIG. 5B. A pair of tension straps 25 and 27 cause both ends of the compression strut 3 to move. The leading end 3L of the compression strut 3 includes a roller 210 that rolls up and down the back side 2B of the door slab. The leading end 3L of the compression strut 3 is near the bottom of the door 2 when the door is in the closed position. The leading end of the compression strut is pulled up the back side 2B of the door 2 and out from the building forcing the door open. The compression strut 3 is attached to the building only via the tension straps and is suspended and moved via these straps. This is similar to FIG. 1 without the cam-shaped drum.

Another preferred embodiment shown in FIG. 5C, referred to as the telescoping compression strut embodiment, is similar to the single active end case except that the compression strut 3 is telescopic, lengthening as the trailing end 3T of the compression strut 3 is drawn toward the pivot point 208. This allows the use of a more compact strut. Partial sectionals of the telescoping strut used in FIG. 5C (many other embodiments are possible) are provided in FIGS. 6A and 6B, including detail not able to be shown in FIG. 5C. In another embodiment, the leading end 3T of the strut could include a roller, that rolls up the back side of the door, rather than strut 3 being hinged to the door.

Figure 6A:
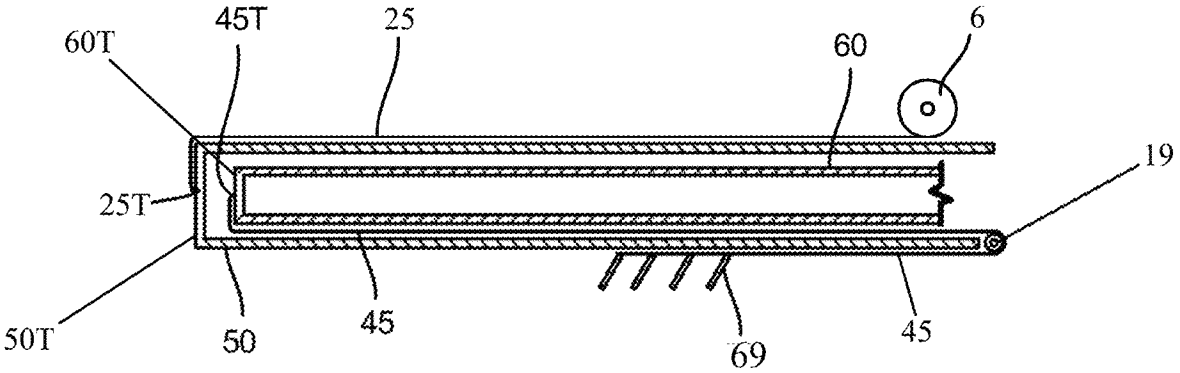
FIG. 6A is a cut away of a portion of a first embodiment of a telescoping strut arrangement, with the telescoping strut in a retracted position.

As shown in FIG. 6A, the telescoping strut includes an outer strut member 50 mounted outside an inner strut member 60. Strap 25 is secured at leading end 25L to winding mechanism 22. The strap runs from the winding mechanism to and around sheave 6, back to a trailing end 50T of the outer strut section 50 of strut 3. A trailing end 45T of strap 45 is secured to a trailing end 60T of inner strut member 60. A second strap 45 is secured at a trailing end 45T to a trailing end 60T of inner strut 60. Strap 45 extends forward, between the inner and outer strut sections towards a leading end of strut 3. From there, the strap wraps around a roller 19 secured to a leading end of the outer strut 50, then winds back 180 degrees, generally parallel with the outer strut section, towards the trailing end of strut 3, where it is secured to a vertical column of the door opening or building structure 69. (Not shown, the door is mounted to the right of the partial telescoping strut shown in FIG. 6A.) As the winding mechanism is turned, strap 40 pulls the telescoping strut toward the direction of the door. Simultaneously, the second strap 45 causes the inner strut to extend. The strut extends twice as fast as strap 40 winds on the winding mechanism.

Figure 6B:
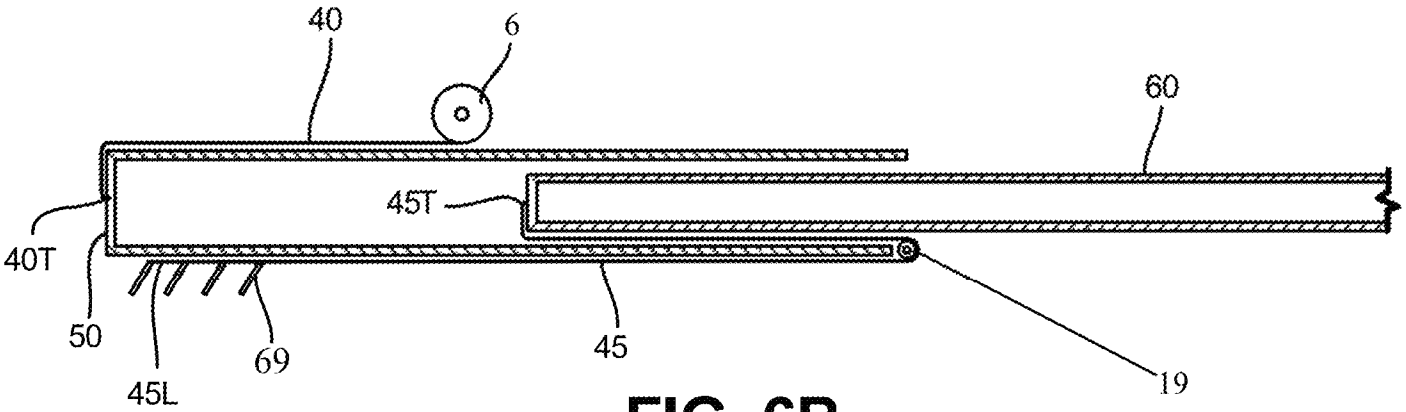
FIG. 6B is the telescoping strut of 6A in an extended position.

In operation, when cable 25 is wound on the winding mechanism 18, the outer strut member is drawn in the direction of the mounted door. (Leading end 3L of the strut is in engagement with the door). Because the length of strap 45 is fixed, and one end of the strap 45 is secured to the building structure 69, movement of the outer strut in the direction of the door causes the inner strut 60 to be drawn out and extend from the outer strut 50, as shown in FIG. 6B. Telescoping of the strut pushes the door to its open position. In an alternative embodiment, instead of securing the strap 45 to the building structure 69, strap 45 can be attached to another winding mechanism located on the building structure and can be wound on the winding mechanism to cause it to extend outward from the outer strut 50.

These embodiments are not limiting as any combination of guide sheaves, winding mechanisms, straps and struts are anticipated by the present invention. One end of the strut can be hinged to the door or the building, or both ends of the strut can be pulled by the strap/cable. The end(s) of the strut that are not pinned can follow a track or can be allowed to "float" in the position dictated by force equilibrium.

Four additional embodiments of the opening mechanisms of the present invention for mono-fold doors are shown in FIGS. 7-10. These four manifestations highlight the use of sheaves/pulleys and fixed anchors as a means of aligning and multiplying forces to efficiently open large door slabs.

The function of these four manifestations of the present invention are generally described as a series of ropes, straps, and cables that form straight lines when pulled tight. Pulleys allow tension straps to change direction under stress. The force in the tension strap remains nearly constant as it goes around a pulley (assuming the pulleys have good bearings). The conservation of force in the cable as it goes around a series of pulleys enables the mechanical advantage of the familiar block and tackle, where two pairs of paired pulleys are connected with a rope that allows lifting a weight that is four times the force in the rope.

The mechanical mono-fold door of the present invention uses similar methods to apply multiples of the tension straps force to the compression strut that pushes the door open. For example, looping the tension strap over a pulley on the trailing end of the compression strut can double the force in the compression strut. The same can be done with the leading end. Pulling both tension straps at the same time causes the ends to move in unison (parallel). Alternatively, the device can be strung with a single tension strap causing only the lowest force end to move at any one time (serial). (See FIG. 7.) Finally, the force in the tension strap can be further reduced by adding more pulleys and engaging additional tension straps. This allows the use of smaller less expensive components running at higher speeds.

Figure 7:
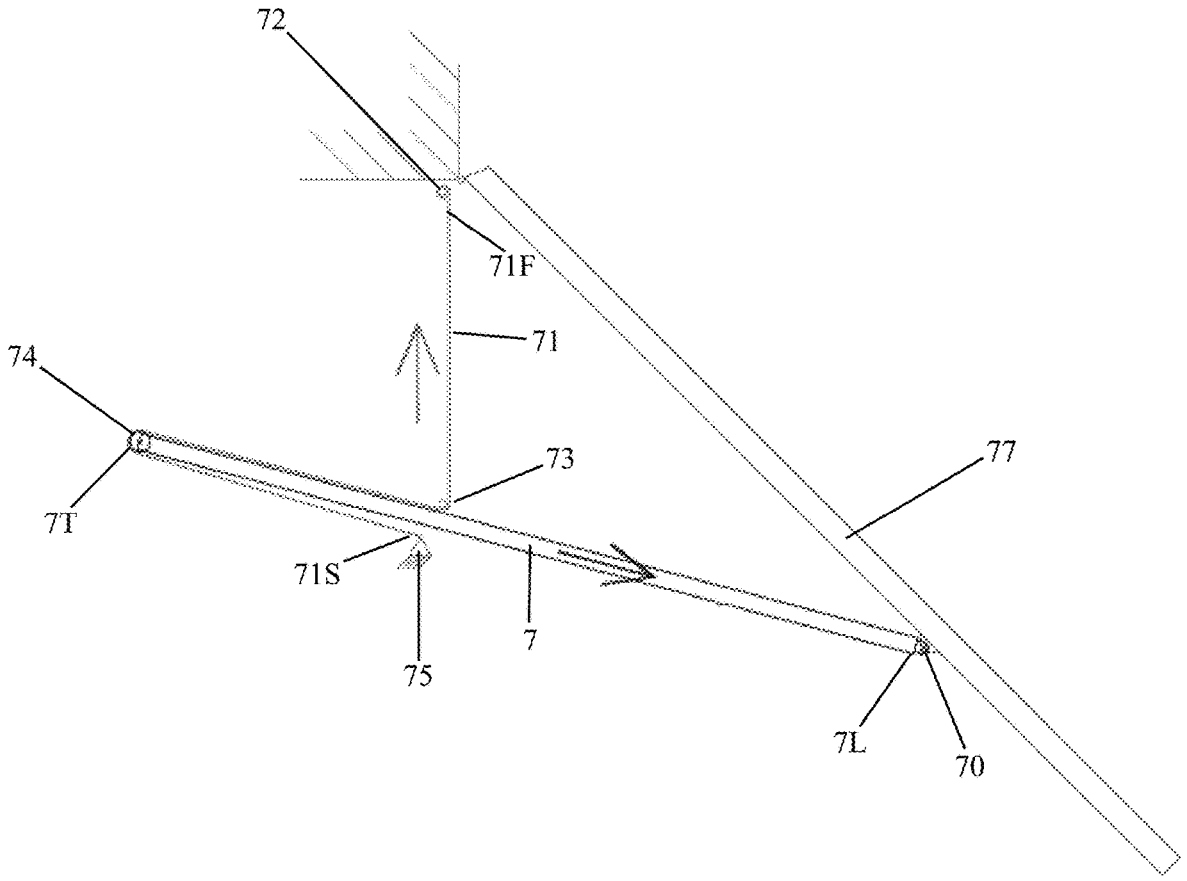
FIG. 7 is an alternate embodiment of the present invention where the strut has an "active" trailing end and a lead end pivotally mounted to a door.

Applying these principles to the present invention, FIG. 7 discloses an alternate "single active end" embodiment with a single tension strap that applies twice the force to the trailing end of the strut. The leading end 7L of the compression strut 7 is pivotally hinged to the door 77 at 70. This provides stability for the system, as it prevents the compression strut 7 from disengaging the door 77. A first end 71F of tension strap 71 is attached to a winding mechanism 72. The tension strap 71 winds around a guide sheave 73 which is fixed to a door jamb of a doorway opening for door 77 (not shown). The tension strap 71 extends to and around a roller or pulley 74 rotatably mounted to the trailing end 7T of the compression strut 7. From there, the tension strap 71 extends to an anchor 75 to which a second end 71S of the tension strap 71 is secured to the anchor 75. In this arrangement, the force on the strut is twice the cable force.

All of the door's motion is achieved by moving the trailing end 7T of the compression strut 7 with the tension strap 71 upon actuation of winding mechanism 72.

Figure 8:
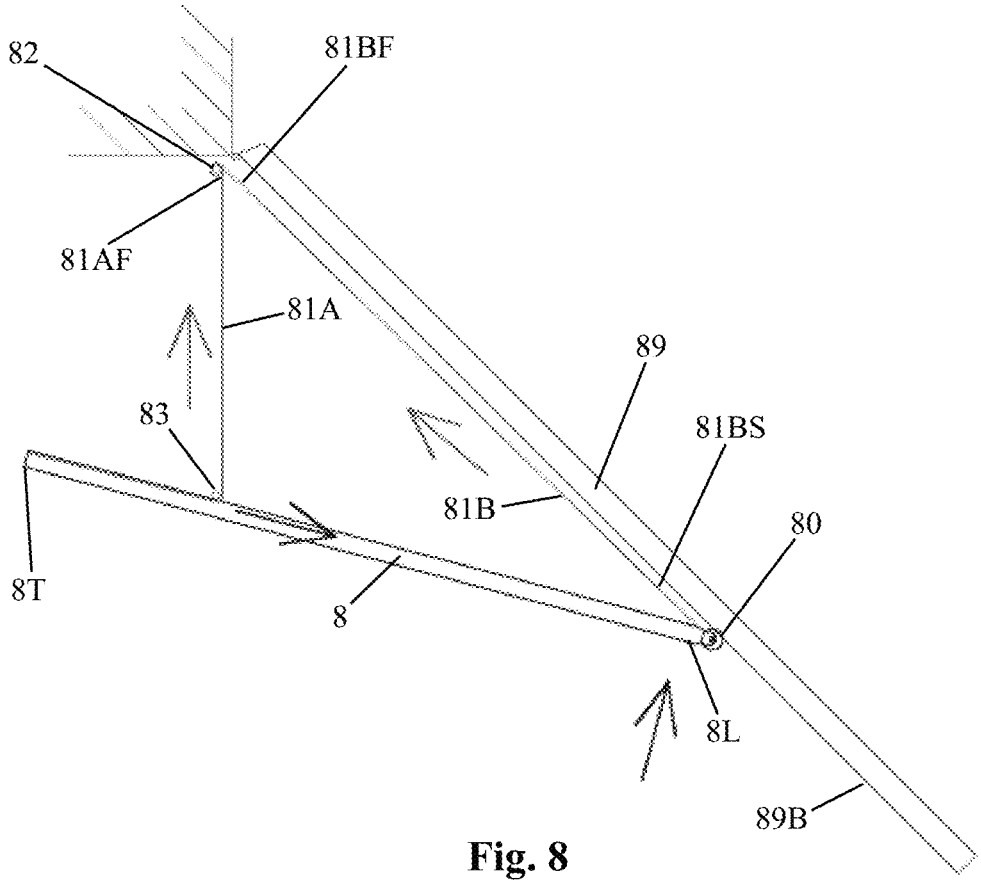
FIG. 8 is an alternate embodiment of the present invention where the strut has active trailing and lead ends and fixed cable ends.

Another embodiment of the present invention, a "double active end," is illustrated in FIG. 8, which is similar to the embodiment in FIG. 1, but without the cam-shaped drum. Compression strut 8 has two active ends, leading end 8L and trailing end 8T. A pair of tension straps 81A and 81B causes both ends of the compression strut 8 to move. The leading end 8L of the compression strut 8 includes a roller 80 that rolls up and down the back side 88B of the door 88. The leading end 8L of the compression strut 8 is near the bottom of the door 88 when the door is in the closed position. The leading end 8L of the compression strut 8 is pulled up the back side 88B of the door 88 and out from the building forcing the door to open.

A first end 81AF of tension strap 81A is attached to a winding mechanism 82. The tension strap 81A winds around a guide sheave or pulley 83 which is fixed to a door jamb of a doorway opening (not shown) for door 88 and then extends and is fixed at or near the trailing end 8T of the compression strut 8.

A first end 81BF of tension strap 81B is attached to the winding mechanism 82. The tension strap 81B extends to the leading end 8L of the compression strut 8, in proximity with a roller 80 mounted to the leading end 8L of the compression strut 8.

When the winding mechanism 82 is rotated in a first direction, it causes the first ends 81AF of tension strap 81A and first end 81BF of tension strap 81B to wind up on the winding mechanism 82. The force of the shortening tension straps 81A and 81B causes the strut to move forward into the door and the leading end 8L of the compression strut 8 to be drawn into and up the backside 88B of the door 88, causing the door 88 to open. Reversing the rotation of the winding mechanism 82 lengthens the tension straps 81A, 81B, allowing the compression strut 8 to retreat into the building and the door to close.

Figure 9:
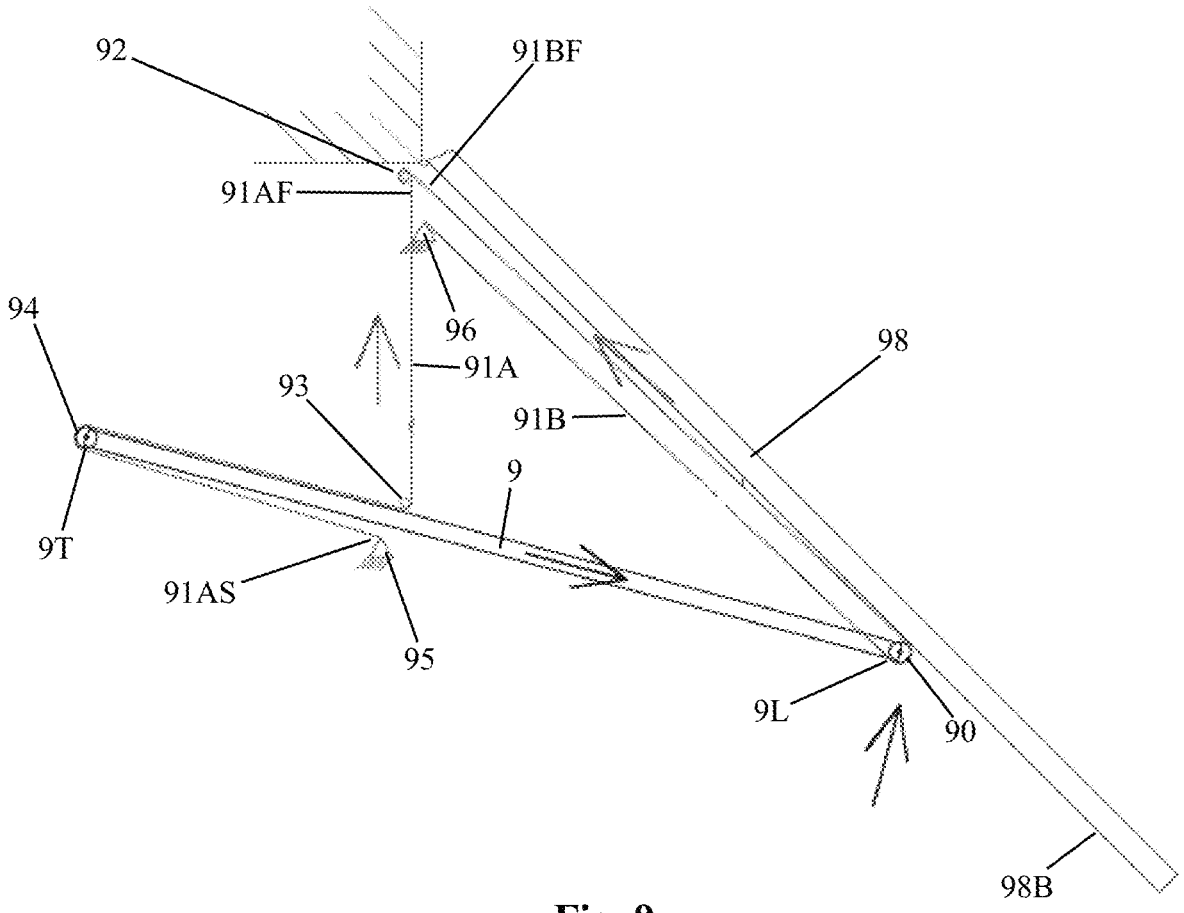
FIG. 9 is an alternate embodiment of the present invention where the strut has active trailing and lead ends and no fixed cable end.

Another preferred embodiment of a "double active end" is shown in FIG. 9. This embodiment utilizes two straps, each strap having portions of their length oriented in parallel to generate greater force on the strut, as illustrated in FIG. 9.

Compression strut 9 has two active ends, leading end 9L and trailing end 9T. A pair of tension straps 91A and 91B causes both ends of the compression strut 9 to move. The leading end 9L of the compression strut 9 includes a roller 90 that rolls up and down the back side 99B of the door slab 99. The leading end 9L of the compression strut 9 is near the bottom of the door 99 when the door is in the closed position. The leading end 9L of the compression strut 9 is pulled up the back side 99B of the door 99 and out from the building forcing the door to open.

A first end 91AF of tension strap 91A is attached to a winding mechanism 92. The tension strap 91A winds around a guide sheave 93 which is fixed to a door jamb of a doorway opening (not shown) for door 99. The tension strap 91A extends generally parallel to the strut, to and around a roller or pulley 94 rotatably mounted to the trailing end 9T of strut 9. From there, the tension strap 91A extends back roughly 180 degrees, generally parallel to the strut, to an anchor 95 to which a second end 91AS of the strap is secured.

A first end 91BF of tension strap 91B is attached to winding mechanism 92. A first leg of the tension strap 91B extends to and winds around a roller or pulley 96 rotatably mounted to the leading end 9L of the compression strut 9, the back, generally parallel to the first leg of the strap, to an anchor 96 secured to a door jamb in close proximity of the winding mechanism 92, where it is secured. In general, strap 91B creates parallel straps that increase the force on the leading end 9L of strut 9, and strap 91A creates parallel straps that increase the force on trailing end 9T of strut 9.

When the winding mechanism 92 is rotated in a first direction, it causes the tension straps 91A, 91B to wind up on the winding mechanism 92 simultaneously. The force of the shortening tension strap 91B causes the trailing end 9T of the strut to force the strut forward into the door, and leading end 9L of the compression strut 9 to be drawn into and up the backside of the door 99, causing the door to open. Reversing the rotation of the winding mechanism 92 lengthens the tension straps 91A, 91B, allowing the compression strut 9 to retreat into the building and the door to close.

Figure 10:
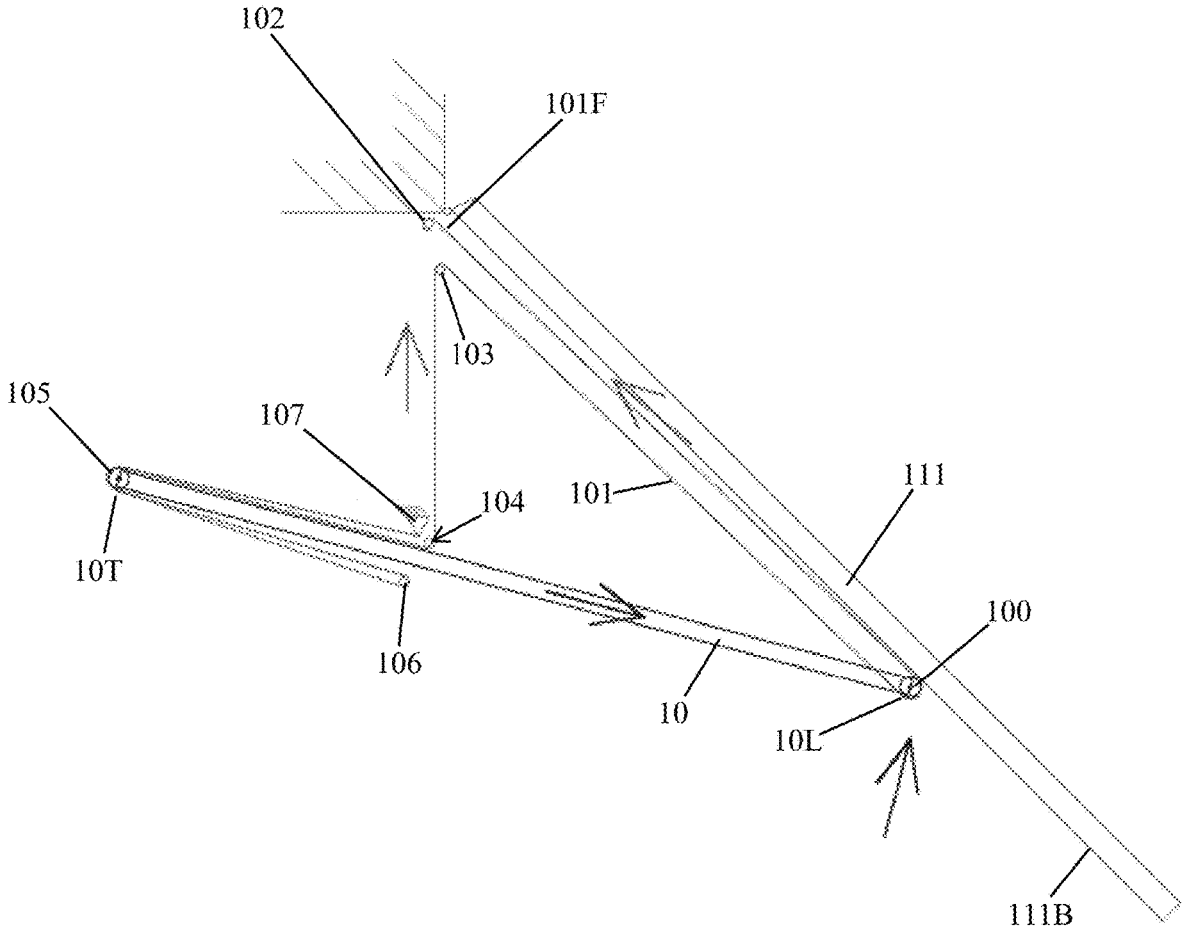
FIG. 10 is an alternate embodiment of the present invention where the strut has active trailing and lead ends and one fixed cable end.
Figure 11A:
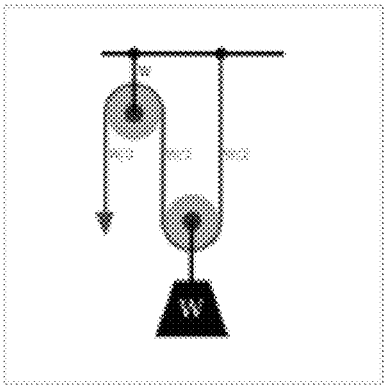
FIG. 11 shows two drawings that disclose the reduction in cable force that can be achieved by using multiple pulleys arranged such that the cable force is applied multiple times to the weight—twice in FIG. 11A and four times in FIG. 11B.
Figure 11B:
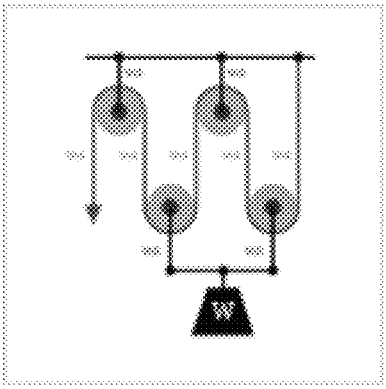

Yet another "double active end" embodiment of the present invention utilizing a single strap is illustrated in FIG. 10, a complex, serial arrangement of the invention. Compression strut 10 has two active ends, leading end 10L and trailing end 10T. A single tension strap 101 causes both ends of the compression strut 10 to move. The leading end 10L of the compression strut 10 includes a roller 100 that rolls up and down the back side 111B of the door 111. The leading end 10L of the compression strut 10 is near the bottom of the door 111 when the door is in the closed position.

A first end 101F of tension strap 101 is attached to a winding mechanism 102. A first leg of the tension strap 101 extends to a leading end 10L of strut 10, on which is mounted a roller or pulley 100. A second leg of the strap extends back towards the winding mechanism 102, generally parallel to the first leg of the strap, to and around a first pulley 103 mounted on the door jamb (not shown) below the winding mechanism 102. From there, the tension strap 101 extends downward to and around a second pulley 104 located below the first pulley 103. From there, the strap extends generally parallel to the strut 10 to the trailing end 10T of the strut, on which is mounted a third roller or pulley 105. From there, the tension strap extends generally parallel to the strut 10 to and around a fourth pulley 106 located below the strut and first and second pulleys 103,104. The tension strap 101 then reverses course around pulley 106, traveling generally parallel to the strut back to and around roller 105, reversing course once again, running generally parallel to the strut to an anchor 107, where it is fixed.

When the winding mechanism 102 is rotated in a first direction, it causes the tension strap 101 to wind up on the winding mechanism 102. The force of the shortening tension strap causes the leading end 10L of the compression strut 10 to be drawn into and up the backside 111B of the door 111, causing the door to open. Reversing the rotation of the winding mechanism 102 lengthens the tension straps 101, allowing the compression strut 10 to retreat into the building and the door 111 to close.

Like the embodiment in FIG. 9, the leading end of the strut sees twice the strap force due to the parallel orientation of the first and second legs of the tension strap. However, the trailing end sees four times the strap force due to the double parallel orientation of the strap on the trailing end of the strut. This causes the trailing end of the strut to move first.

The configurations of the present invention can be adjusted in many ways, including the number and location of the rollers, sheaves, tension straps and anchors, to achieve the desired goal of applying pressure to a door to open it, using a strut, one or more tension strap, and sheaves and anchors as required.

The use of terminology discussing the method in which tension is created to open or close the door is not meant to be limiting and should be construed as a basic description of the invention. As an example, the use of the term "tension strap" the description could be revised to use terms such as "cable", "strap" or any known means that is in existence within the market.

Finally, components identified above as being attached to vertical columns of the doorway or the doorway header may be attached to other building structures and surfaces as may be suitable for operation of the door opening and closing mechanism and door.

The invention claimed is:

1. A door opener mechanism for opening and closing a top hinged mono-fold door having a back surface, the mono-fold door being mounted within an opening defined by a door frame, the door frame defined by two spaced vertical members and a header supported in a generally horizontal orientation mounted between or above the vertical members, the mono-fold door being rotatably mounted to the header or vertical members, the door opener mechanism comprising:

a. a winding mechanism to be secured to the door frame, the winding mechanism including means for engaging a line and means for operatively engaging an actuator;

b. a strut having a leading end for engaging the mono-fold door and an opposite trailing end that does not operatively engage the door frame;

c. at least one line having a first end for operatively engaging the winding mechanism and a second end for operatively engaging the strut;

d. an actuator operatively engaging the winding mechanism, the actuator including means for rotating the winding mechanism in a first and opposite second direction, such that when the winding mechanism is rotated in the first direction, the strut moves from a first open door position to a second closed door position, and when the winding mechanism is rotated in the second direction, the strut moves back from the second closed door position to the first open door position.

2. The door opening mechanism of claim 1 further comprising one or more guide sheaves selectively positioned and secured to the door frame to direct the force applied by the line to the strut to increase the efficiency of the door moving between the first closed door and second open door position.

3. The door opening mechanism of claim 1 further comprising one or more rollers selectively positioned and secured to the strut to direct the force applied by the line to the strut to increase the efficiency of the door moving between the first closed door and second open door position.

4. The door opening mechanism of claim 1 further comprising one or more anchors for securing one end of the line, the anchors being positioned and secured to the door frame or other fixed surfaces to increase the efficiency of the door moving between the first closed door position and second open door position.

5. The door opening mechanism of claim 1 further comprising one or more of the following to direct the force applied by the line to the strut to improve the efficiency of the door moving between the first closed door position and second open door position: (i) one or more guide sheaves selectively positioned and secured to the door frame or other fixed surface; (ii) one or more rollers selectively positioned and secured to the strut; and (iii) one or more anchors for securing one end of the line, the anchors being positioned and secured to the door frame or other fixed surfaces.

6. The door opening mechanism of claim 5 comprising two or more lines for operatively engaging one or more of: (i) the winding mechanism, (ii) the strut, (iii) the one or more guide sheaves; or (iv) the one or more anchors.

7. The door opening mechanism of claim 1 wherein the strut is formed from wood, steel or other compression resistant material.

8. The door opening mechanism of claim 1 wherein a track is mounted on the back side of the mono-fold door and the leading end of the strut slidably engages the track.

9. The door opening mechanism of claim 1 wherein a counter weight is secured to the winding drum.

10. The door opening mechanism of claim 1 wherein the leading end of the strut includes a roller that rotatably engages a track mounted on the back side of the door panel.

11. The door opening mechanism of claim 1 wherein the strut is telescoping.

12. The door opening mechanism of claim 1 further comprising one or more guide sheave mounted on the vertical members to engage the line, the one or more guide sheave being spaced a distance from the trailing end of the strut, so that when the line is wound on the winding mechanism, a force acts upon the trailing end of the strut to push the leading end of the strut into the back side of the door to move it from the first closed door position to the second open door position.

13. The door opening mechanism of claim 1 wherein the leading end of the strut travels in a track on the back side of the door and the trailing end of the strut is suspended by the line and moves in a path dictated only by force equilibrium.

14. The door opening mechanism of claim 1 wherein the winding mechanism includes a cam sized and shaped to create a near constant input force to the strut as the door moves from the first closed door position to the second open door position.

15. The door opening mechanism of claim 1 wherein the lines are one of a cable, wire, rope, chord or strap.

16. The door opening mechanism of claim 1 wherein the trailing end of the strut is suspended by a cable.

17. The door opening mechanism of claim 1 wherein the trailing end of the strut is secured to a line for at least two-dimensional movement.

18. The door opening mechanism of claim 1 wherein the leading end of the strut sits vertically below the trailing end of the strut when in the second closed door position.

19. A door opener mechanism for opening and closing a top hinged mono-fold door having a back surface, the mono-fold door being mounted within an opening defined by a door frame, the door frame defined by two spaced vertical members and a header supported in a generally horizontal orientation mounted between or above the vertical members, the mono-fold door being rotatably mounted to the header or vertical members, the door opener mechanism comprising:

a. a first winding mechanism to be secured to the door frame, the winding mechanism including means for engaging a line, a winding drum on which a line can be wound and means for operatively engaging a actuator;

b. a first strut having a leading end for engaging the mono-fold door and an opposite trailing end of the strut that does not operatively engage the door frame;

c. at least one first line having a first end for operatively engaging the winding drum and a second end for operatively engaging the first strut;

d. a second winding mechanism to be secured to the door frame in spaced relation from the first winding mechanism, the second winding mechanism including means for engaging a second line, a second winding drum on which a second line can be wound;

e. a second strut in spaced relationship with the first strut, the second strut having a leading end for engaging the mono-fold door and an opposite trailing end that does not operatively engage the door frame;

f. at least one second line having a first end for operatively engaging the second winding drum and a second end for operatively engaging the second strut;

g. a first actuator operatively engaging the first winding drum, the first actuator including means for rotating the first winding drum;

h. one of: (i) a second actuator operatively engaging the second winding drum, the second actuator including means for rotating the second winding drum, or (ii) a rod connected to the first and second winding drums to ensure the first and second drums turn in unison;

i. such that when the first and second winding drums are rotated in a first direction, the first and second lines wind up on their corresponding winding drums, causing the first and second struts to move from a first position to a second position, forcing the door to rotate upward from a first closed door position to a second open door position, and when the first and second winding drums are rotated in an opposite second direction, the first and second lines unwind from the first and second winding drums, respectively, causing the first and second struts to move back from the second open door position to the first closed door position.

20. The door opening mechanism of claim 19 wherein the first and second struts are attached to a third line such that both ends of the first and second struts move in unison.

* * * * *